US005427376A

United States Patent [19]

Cummings et al.

[11] Patent Number: 5,427,376

[45] Date of Patent: Jun. 27, 1995

[54] GOLF CLUB GRIP WITH FIRST INDICIA TO INDICATE WHERE THE THUMBS AND FINGERS OF A PLAYER ARE TO BE LOCATED AND OTHER INDICIA TO INDICATE OTHER AREAS

[76] Inventors: Patricia M. Cummings; Clarence W. Cummings, both of 1913 Meadow La., Blytheville, Ark. 72315

[21] Appl. No.: 260,254

[22] Filed: Jun. 14, 1994

[51] Int. Cl.[6] ..... A63B 69/36

[52] U.S. Cl. ..... 273/187.5; 273/81.4; 273/81 B

[58] Field of Search ..... 273/163 R, 163 A, 81 R, 273/81.4, 81.6, 81 B, 81 D, 187.4, 187.5, 186.2, 72 R, 72 A, 75, 26 B; D21/222

[56] References Cited

U.S. PATENT DOCUMENTS

| | | | |
|---|---|---|---|
| D. 125,602 | 3/1941 | Wheeler | 273/81.4 |
| D. 284,298 | 6/1986 | Kobayashi | 273/81.4 X |
| 1,556,473 | 10/1925 | Ballou | 273/81.4 |
| 1,587,082 | 6/1926 | Mattern | 273/81 B |
| 1,648,175 | 11/1927 | Hamel | 273/81 R |
| 2,091,512 | 8/1937 | Marsh | 273/81.4 |
| 2,177,143 | 10/1939 | Lamkin | 273/81.6 |
| 2,690,338 | 9/1954 | Brocke | 273/81.4 |
| 3,111,322 | 11/1963 | English | 273/187.5 |
| 3,173,689 | 3/1965 | Serblin | 273/81 R |
| 3,606,326 | 9/1971 | Sparks | 273/75 |
| 4,006,896 | 2/1977 | Soldavini | 273/75 |
| 4,317,568 | 3/1982 | Green | 273/163 A |
| 5,087,042 | 2/1992 | Solheim | 273/81 B |

*Primary Examiner*—Sebastiano Passaniti

[57] ABSTRACT

A golf club grip with first indicia to indicate where the thumbs and fingers of a player are to be located and other indicia to indicate other areas comprising an essential cylindrical grip member formed with an upper closed end and a lower opened end and with a peripheral side wall having an interior surface and an exterior surface, the interior surface being of a common cross-sectional configuration along its length to fit in frictional contact with the upper end of a golf club to which it is to be coupled, the exterior surface of the grip being formed with a slightly greater diameter at its upper end than at its lower end and gradually decreasing in diameter from the upper end to the lower end, the lower end of the grip being open for mounting and un-mounting the grip on the upper end of a golf club; a plurality of primary indicia markings in green at three locations on the exterior surface of the grip to indicate where the player is to position his hands; and supplemental indicia markings in red and roughened in all areas not of the primary indicia to indicate regions of the exterior surface of the grip not to be contacted by the hands of a player.

3 Claims, 4 Drawing Sheets

GOLF CLUB GRIP WITH FIRST INDICIA TO INDICATE WHERE THE THUMBS AND FINGERS OF A PLAYER ARE TO BE LOCATED AND OTHER INDICIA TO INDICATE OTHER AREAS

BACKGROUND OF THE INVENTION

1. Field of the Invention

The present invention relates to a golf club grip with first indicia to indicate where the thumbs and fingers of a player are to be located and other indicia to indicate other areas and more particularly pertains to ensuring a proper gripping of a golf club by a player when swinging a golf club.

2. Description of the Prior Art

The use of golf club grips of various constructions including indicia and contours of various sorts is known in the prior art. More specifically, golf club grips of various constructions including indicia and contours of various sorts heretofore devised and utilized for the purpose of marking the exterior surface of golf grips for assisting in the proper hand placement of a golfer are known to consist basically of familiar, expected, and obvious structural configurations, notwithstanding the myriad of designs encompassed by the crowded prior art which has been developed for the fulfillment of countless objectives and requirements.

By way of example, U.S. Pat. Des. No. 335,320 to McCarty discloses a training aid attachment for a golf club grip.

U.S. Pat. No. 3,806,130 to Jacques discloses a golf club grip training aid.

U.S. Pat. No. 4,138,118 to Budney discloses a golf club grip training device.

U.S. Pat. No. 4,861,034 to Lee discloses a golf-grip training device.

Lastly, U.S. Pat. No. 4,930,785 to Mills discloses a golf grip training apparatus.

In this respect, the golf club grip with first indicia to indicate where the thumbs and fingers of a player are to be located and other indicia to indicate other areas according to the present invention substantially departs from the conventional concepts and designs of the prior art, and in doing so provides an apparatus primarily developed for the purpose of to ensure a proper gripping of a golf club by a player when swinging a golf club.

Therefore, it can be appreciated that there exists a continuing need for a new and improved golf club grip with first indicia to indicate where the thumbs and fingers of a player are to be located and other indicia to indicate other areas which can be used for to ensure a proper gripping of a golf club by a player when swinging a golf club. In this regard, the present invention substantially fulfills this need.

SUMMARY OF THE INVENTION

In view of the foregoing disadvantages inherent in the known types of golf club grips of various constructions including indicia and contours of various sorts now present in the prior art, the present invention provides an improved golf club grip with first indicia to indicate where the thumbs and fingers of a player are to be located and other indicia to indicate other areas. As such, the general purpose of the present invention, which will be described subsequently in greater detail, is to provide a new and improved golf club grip with first indicia to indicate where the thumbs and fingers of a player are to be located and other indicia to indicate other areas and method which has all the advantages of the prior art and none of the disadvantages.

To attain this, the present invention essentially comprises a new and improved golf club grip with first indicia to indicate where the thumbs and fingers of a player are to be located and other indicia to indicate other areas comprising, in combination, an essential cylindrical grip member formed with an upper closed end and a lower opened end and with a peripheral side wall having an interior surface and an exterior surface, the interior surface being of a common cross-sectional configuration along its length to fit in frictional contact with the upper end of a golf club to which it is to be coupled, the exterior surface of the grip being formed with a slightly greater diameter at its upper end than at its lower end and gradually decreasing in diameter from the upper end to the lower end, the lower end of the grip being open for mounting and un-mounting the grip on the upper end of a golf club; three primary indicia markings in green, the indicia markings being at three locations on the surface of the grip, the first indicia marking being a mark on the upper surface near the bottom end for the right thumb, the second indicia marking being on the upper surface near the top and for the left thumb, and the third indicia marking being wrapped around from the upper surface to the lower surface along the length of the grip for the fingers; supplemental indicia markings in red and roughened in all areas not of the primary indicia markings to indicate regions of the exterior surface of the grip not to be contacted by the hands of a player; and a downwardly facing arrow on the upper surface adjacent to the bottom end facing downwardly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf club grip with first indicia to indicate where the thumbs and fingers of a player are to be located and other indicia to indicate other areas which has all the advantages of the prior art golf club grips of various constructions including indicia and contours of various sorts and none of the disadvantages.

It is another object of the present invention to provide a new and improved golf club grip with first indicia to indicate where the thumbs and fingers of a player are to be located and other indicia to indicate other areas which may be easily and efficiently manufactured and marketed.

It is further object of the present invention to provide a new and improved golf club grip with first indicia to indicate where the thumbs and fingers of a player are to be located and other indicia to indicate other areas which is of durable and reliable constructions.

An even further object of the present invention is to provide a new and improved golf club grip with first indicia to indicate where the thumbs and fingers of a player are to be located and other indicia to indicate other areas which is susceptible of a low cost of manufacture with regard to both materials and labor, and which accordingly is then susceptible of low prices of sale to the consuming public, thereby making such golf club grip with first indicia to indicate where the thumbs and fingers of a player are to be located and other indicia to indicate other areas economically available to the buying public.

Still yet another object of the present invention is to provide a new and improved golf club grip with first indicia to indicate where the thumbs and fingers of a player are to be located and other indicia to indicate other areas which provide in the apparatuses and methods of the prior art some of the advantages thereof, while simultaneously overcoming some of the disadvantages normally associated therewith.

Even still another object of the present invention is to ensure a proper gripping of a golf club by a player when swinging a golf club.

Lastly, it is an object of the present invention to provide a new and improved golf club grip with first indicia to indicate where the thumbs and fingers of a player are to be located and other indicia to indicate other areas comprising an essential cylindrical grip member formed with an upper closed end and a lower opened end and with a peripheral side wall having an interior surface and an exterior surface, the interior surface being of a common cross-sectional configuration along its length to fit in frictional contact with the upper end of a golf club to which it is to be coupled, the exterior surface of the grip being formed with a slightly greater diameter at its upper end than at its lower end and gradually decreasing in diameter from the upper end to the lower end, the lower end of the grip being open for mounting and un-mounting the grip on the upper end of a golf club; a plurality of primary indicia markings in green at three locations on the exterior surface of the grip to indicate where the player is to position his hands; and supplemental indicia markings in red and roughened in all areas not of the primary indicia to indicate regions of the exterior surface of the grip not to be contacted by the hands of a player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
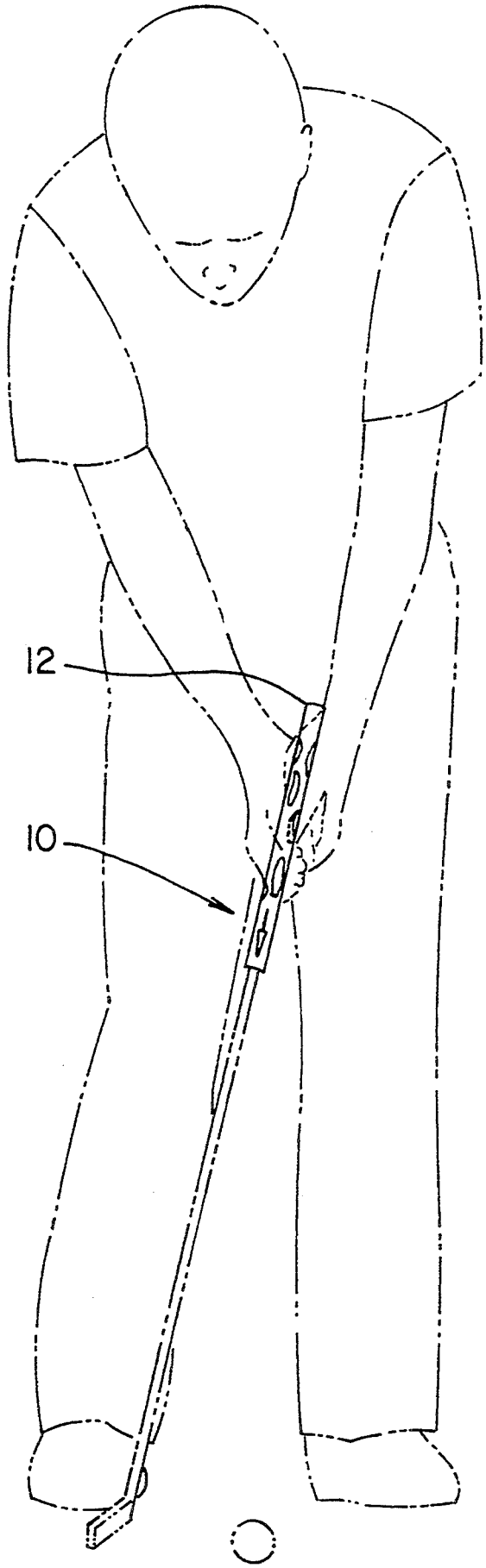
FIG. 1 is a perspective illustration of the preferred embodiment of the golf club grip with first indicia to indicate where the thumbs and fingers of a player are to be located and other indicia to indicate other areas constructed in accordance with the principles of the present invention.
Figure 2:
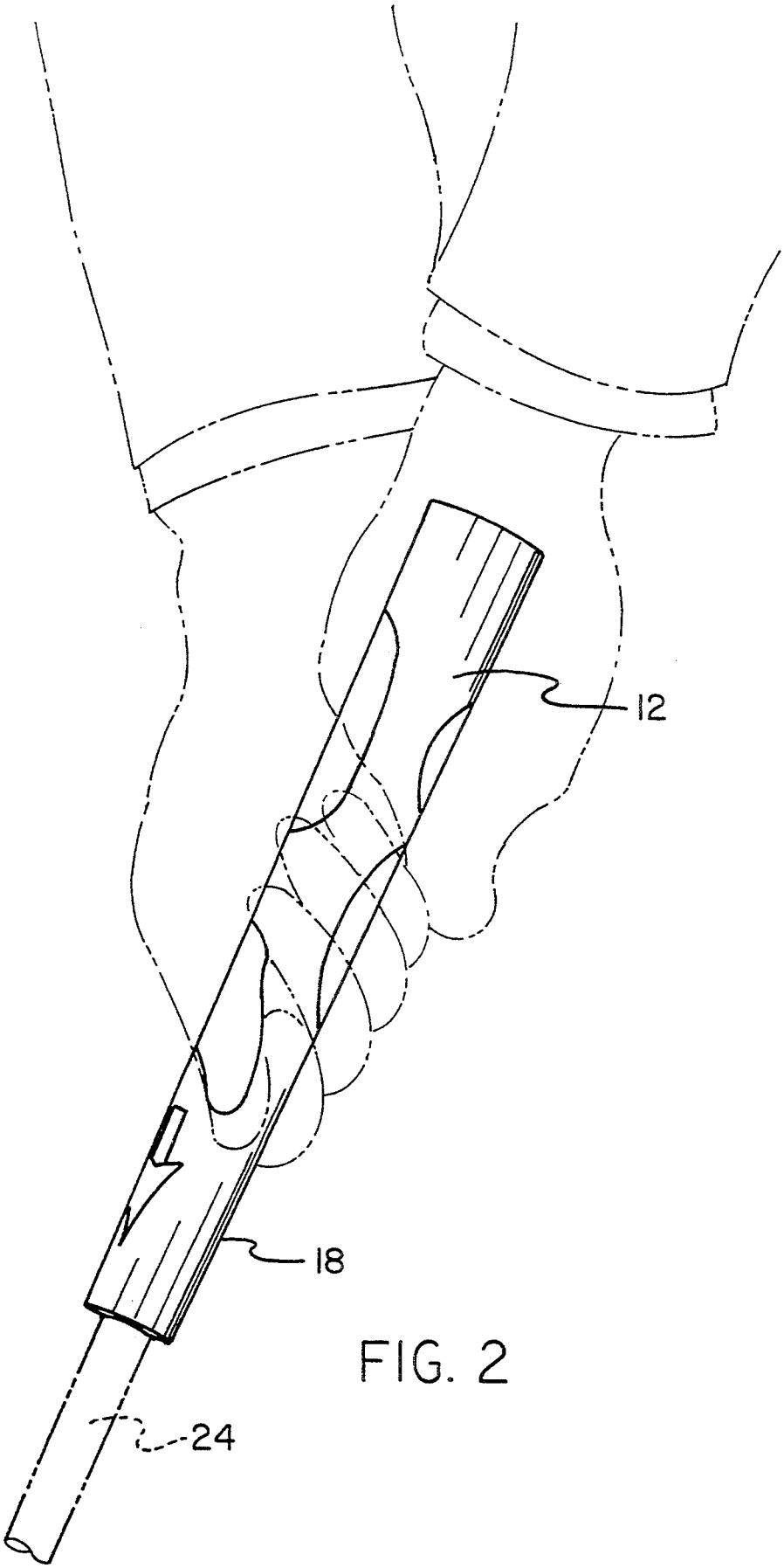
FIG. 2 is an enlarged perspective illustration of the upper portion of the shaft and the grip being held by a player.
Figure 3:
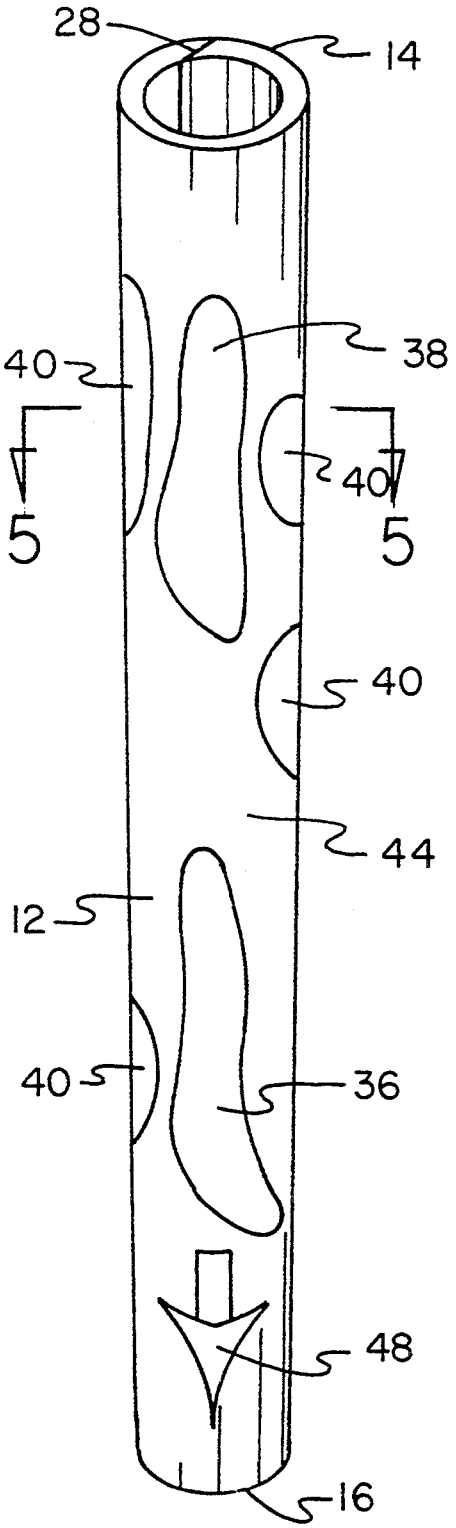
FIG. 3 is a front perspective illustration of the golf grip of the prior Figures.
Figure 4:
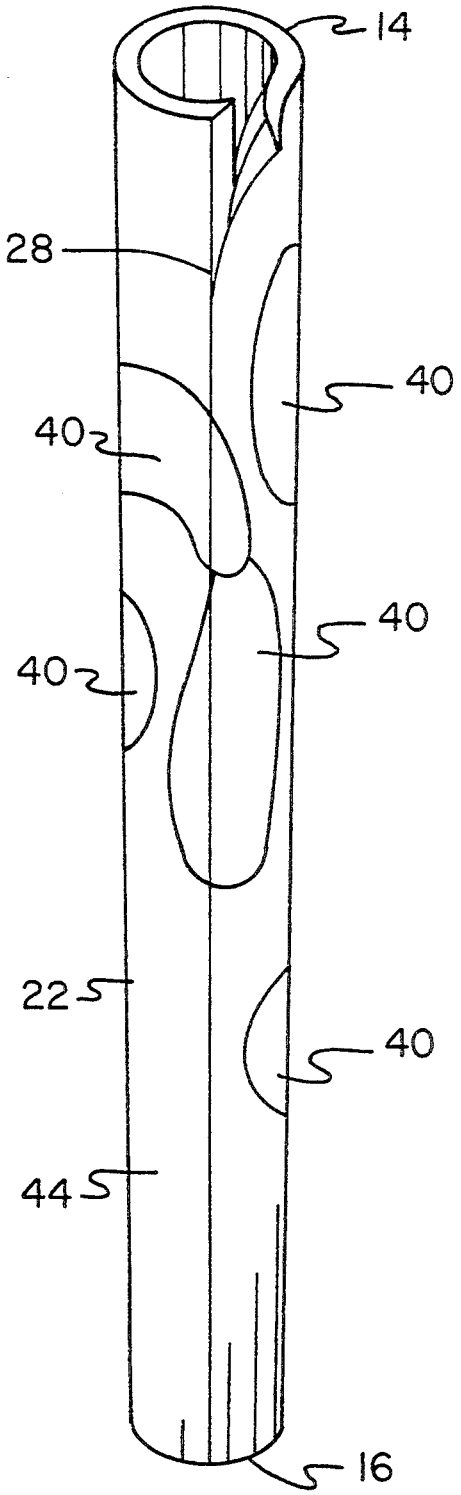
FIG. 4 is a rear elevational view of the golf grip of the prior Figures.
Figure 5:
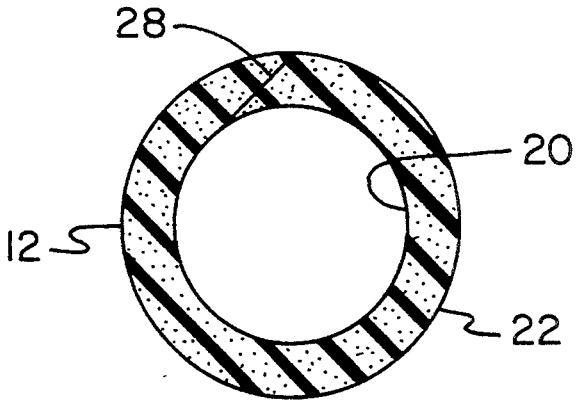
FIG. 5 is a cross-sectional view of the grip taken along line 5—5 of FIG. 4.
Figure 6:
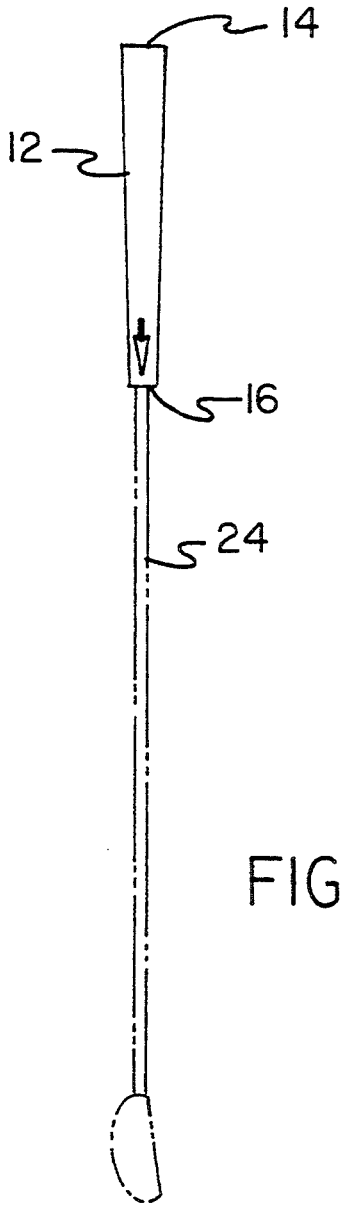
FIG. 6 is a front elevational view of a golf club provided with the grip of the prior Figures.

With reference now to the drawings, and in particular to FIG. 1 thereof, the preferred embodiment of the new and improved golf club grip with first indicia to indicate where the thumbs and fingers of a player are to be located and other indicia to indicate other areas embodying the principles and concepts of the present invention and generally designated by the reference numeral 10 will be described.

The present invention, the new and improved golf club grip with first indicia to indicate where the thumbs and fingers of a player are to be located and other indicia to indicate other areas is comprised of a plurality of components. Such components, in their broadest context, include a cylindrical member, a disk shaped end cap, primary indicia markings and supplemental indicia markings. Such components are individually configured and correlated with respect to each other so as to attain the desired objective.

The present invention is a system 10 which has as its central component an essentially cylindrical member or grip 12. Such grip member is formed with an upper or top opened end 14 and a lower or bottom opened end 16. The member also includes a peripheral side wall 18. The side wall has an interior surface 20 and an exterior surface 22. The interior surface is of a common cross-sectional configuration along its length. This allows the member to be fitted in frictional contact with the upper end of a golf club shaft 24 to which it is to be coupled for use. The exterior surface of the grip is formed with a slightly greater diameter at its upper end than at its lower end. The exterior surface then gradually decreases in diameter to taper from the upper end to the lower end. The lower end of the grip is open for mounting and un-mounting the grip on the upper end of the golf club.

The grip is preferably fabricated of a closed cell polymeric foam. In this manner, the grip will be of greater comfort to the user. It will also be able to fit over a large number of shafts regardless of their diameter. An other feature of the club to increase its utility is a slit 28. Such slit is offset from the radius of the grip and shaft. It overlaps to provide a closed configuration and appearance when mounted on the golf club for operation and use.

Next provided are three primary indicia markings. Such markings are preferably color coded in green. The indicia markings are at three locations on the upper surface of the grip. The first indicia marking 36 being a mark on the upper surface near the bottom end for the right thumb, the second indicia 38 being a mark on the upper surface near the top and for the left thumb, and the third indicia 40 being a mark wrapped around from the upper surface to the lower surface along the length of the grip for the fingers.

The last component of the system is the supplemental indicia markings 44. Such markings are in red for contrast with the green markings of the primary indica. The red markings are to indicate caution and identify areas from the external surface of the grip where the hands of the player are not to be located. The color is further accentuated by having such areas on the exterior surface of the grip of a roughened texture. This will not only provide a visual appearance of where hands should not be placed, but they provide a feel where such hands should not be placed to supplement the color variation.

The last indicia marking is an arrow 48. Such arrow is on the exterior surface of the grip. It is centrally located on the upper surface adjacent to the bottom end. It functions to show the golfer the position of his club, grip and ball with regard to his hands.

The present invention is a training aid for golfers. It is used to show how a golf club is to be gripped and to be in a way which has been accepted as the preferred and ideal technique. Professionals insist that a proper grip is the foundation for developing a good swing, which is often called a grooved swing, because it is reproduced exactly, every time a shot is made. While some golfers are able to play well using other gripping techniques, such as those known as the baseball and interlocking grips, it is widely agreed that there is only one ideal way to grip a golf club. However, this is very difficult to teach, because it feels totally unnatural, very weak, and extremely clumsy when first tried. The grip has been adopted because the only way the ball can be hit well is to have a perfect take-away, body turn, weight transfer and arm and hand action during the swing. The procedure must be repeated exactly in the same manner each time a swing is taken, so the golfer will eventually develop a grooved swing if they exercise patience and perseverance.

The training aid is a foam rubber sleeve which is placed over the golf club grip. Because of its elasticity, it is made so that one size fits all clubs. It has an arrow at the lower end to align it with the face of the club head. Three green spots on the grip indicate where each thumb and fingers are to be placed. Four red marks and rough surfaces show where they are not to be placed.

The present invention is used in practice until the correct grip becomes perfectly natural. Instructions would be provided with the aid to guide how the device is to be used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved golf club grip for use with a golf club having an upper end and a lower end and with first indicia to indicate where the thumbs and fingers of a player are to be located and other indicia to indicate other areas comprising, in combination:

an essentially cylindrical grip member formed with an upper closed end and a lower opened end and with a peripheral side wall having an interior surface and an exterior surface, the exterior surface having a top facing upwardly when holding the grip while addressing the ball and a bottom facing downwardly when holding the grip while addressing the ball, the interior surface being of a common cross-sectional configuration along its length to fit in frictional contact with the upper end of a golf club to which it is adapted to be coupled, the exterior surface of the grip being formed with a slightly greater diameter at an upper end than at a lower end thereof and gradually decreasing in diameter from the upper end to the lower end, the lower end of the grip being open to render the grip adapted for mounting and un-mounting on an upper end of a golf club;

three primary indicia markings in green, the indicia markings being at three locations on the surface of the grip, the first indicia marking being a mark on the top near the lower end for the right thumb, the second indicia marking being on the top near the upper end and for the left thumb, and the third indicia marking being wrapper around the top to the bottom along the length of the grip for the fingers;

supplemental indicia markings in red and roughened in all areas not of the primary indicia markings to indicate regions of the exterior surface of the grip not to be contacted by the hands of a player; and an arrow on the top adjacent to the bottom end facing toward the lower end.

2. A golf club grip for use with a golf club having an upper end and a lower end and with first indicia to indicate where the thumbs and fingers of a player are to be located and other indicia to indicate other areas comprising:

an essentially cylindrical grip member formed with an upper closed end and a lower opened end and with a peripheral side wall having an interior surface and an exterior surface, the exterior surface having a top facing upwardly when holding the grip while addressing the ball and a bottom facing downwardly when holding the grip while addressing the ball the interior surface being of a common cross-sectional configuration along its length to fit in frictional contact with the upper end of a golf club to which it is adapted to be coupled, the exterior surface of the grip being formed with a slightly greater diameter at an upper end than at a lower end thereof and gradually decreasing in diameter from the upper end to the lower end, the lower end of the grip being open to render the grip adapted for mounting and un-mounting on an upper end of a golf club;

a plurality of primary indicia markings in green at three locations on the exterior surface of the grip to indicate where the player is to position his hands; and supplemental indica markings in red and roughened in all areas not of the primary indicia to indicate regions of the exterior surface of the grip not to be contacted by the hands of a player.

3. The device as set forth in claim 2 wherein the primary indicia markings include indicia at three locations, the first indicia marking being a mark on the top near the lower end for the right thumb, the second indicia marking being on the top near the upper end and for the left thumb, and the third indica marking being wrapped around from the top to the bottom along the length of the grip for the fingers.

* * * * *